US008763619B2

(12) United States Patent
Lele et al.

(10) Patent No.: US 8,763,619 B2
(45) Date of Patent: Jul. 1, 2014

(54) COMBINATION AGITATING PARTS WASHER AND SINK WASHER

(75) Inventors: Ashok S. Lele, Elgin, IL (US); Scott D. Lisberg, Elburn, IL (US); Thomas G. Hillstrom, Crystal Lake, IL (US)

(73) Assignee: Heritage-Crystal Clean, LLC, Elgin, IL (US)

( * ) Notice: Subject to any disclaimer, the term of this patent is extended or adjusted under 35 U.S.C. 154(b) by 576 days.

(21) Appl. No.: 12/816,228

(22) Filed: Jun. 15, 2010

(65) Prior Publication Data

US 2010/0307544 A1 Dec. 9, 2010

Related U.S. Application Data

(63) Continuation-in-part of application No. 12/322,233, filed on Jan. 29, 2009, now Pat. No. 8,297,291, which is a continuation-in-part of application No. 10/658,950, filed on Sep. 9, 2003, now Pat. No. 7,484,515.

(51) Int. Cl.
*B08B 3/00* (2006.01)

(52) U.S. Cl.
USPC ..... 134/147

(58) Field of Classification Search
USPC ..... 134/147
See application file for complete search history.

(56) References Cited

U.S. PATENT DOCUMENTS

| | | | |
|---|---|---|---|
| 1,395,728 | A | 11/1921 | Ormes |
| 2,579,393 | A | 12/1951 | John |
| 2,675,012 | A | 4/1954 | Scales |
| 2,680,802 | A | 6/1954 | Bremer et al. |
| 3,026,699 | A | 3/1962 | Rhodes |
| 3,514,330 | A | 5/1970 | Leedy et al. |
| 3,680,567 | A | 8/1972 | Hansen |
| 3,771,772 | A | 11/1973 | Honda |
| 3,874,641 | A | 4/1975 | Tolan |

(Continued)

FOREIGN PATENT DOCUMENTS

| | | | |
|---|---|---|---|
| EP | 2418021 | A2 | 2/2012 |
| JP | 60-130832 | A | 7/1985 |
| JP | 06252120 | A * | 9/1994 |

OTHER PUBLICATIONS

Abe et al., Sep. 1994, JP 06-252120, English machine translation of Abstract.*

(Continued)

*Primary Examiner* — Jason Ko
(74) *Attorney, Agent, or Firm* — Levenfeld Pearlstein, LLC

(57) ABSTRACT

A multi-function parts washer for removing contaminants from parts either by hand or automatically using an aqueous cleaning fluid includes a base cabinet having sides, a floor and an open top defining a compartment. A parts receptacle is mounted in the compartment for receiving parts to be washed. The receptacle is mounted for reciprocating, vertical movement in the compartment. An agitator assembly includes one or more compressed gas bladders mounted to the parts receptacle. The bladder has an inlet for introducing compressed gas into the bladder and an outlet for discharge of the compressed gas from the bladder. As compressed gas is introduced into the bladder, the bladder inflates and the parts receptacle is raised, and as compressed gas is discharged from the bladder, the parts receptacle is lowered to provide an agitating motion of the parts receptacle and the parts thereon in the cleaning fluid. The agitator can include a hydraulic cylinder to effect movement of the parts receptacle.

14 Claims, 10 Drawing Sheets

(56) References Cited

U.S. PATENT DOCUMENTS

| | | | | |
|---|---|---|---|---|
| 3,971,394 | A | 7/1976 | Osborne | |
| 4,128,478 | A | 12/1978 | Metzger | |
| 4,776,359 | A | 10/1988 | Federighi et al. | |
| 5,088,510 | A | 2/1992 | Bannon | |
| 5,232,299 | A | 8/1993 | Hiss | |
| 5,349,708 | A | 9/1994 | Lee | |
| 5,368,053 | A | 11/1994 | Wilson | |
| 5,409,308 | A | 4/1995 | Reuter et al. | |
| 5,482,064 | A | 1/1996 | Goddard | |
| 5,499,643 | A | 3/1996 | Vincent, Jr. et al. | |
| 5,528,913 | A | 6/1996 | Savkar | |
| 5,640,981 | A | 6/1997 | Niemela et al. | |
| 6,115,541 | A | 9/2000 | Rhodes | |
| 6,279,587 | B1 * | 8/2001 | Yamamoto | 134/57 R |
| 6,306,221 | B1 | 10/2001 | Magliocca | |
| 6,368,414 | B1 | 4/2002 | Johnson | |
| 6,568,409 | B1 | 5/2003 | Fleck | |
| 2005/0199267 | A1 | 9/2005 | Oakes | |
| 2008/0210260 | A1 | 9/2008 | Porter et al. | |
| 2008/0210276 | A1 | 9/2008 | Porter et al. | |
| 2008/0210280 | A1 | 9/2008 | Publ | |
| 2011/0214698 | A1 | 9/2011 | Hrubetz et al. | |

OTHER PUBLICATIONS

Professional Tool & Equipment News, vol. 14, No. 4, May 2003; a Cygnus Publication, published by Cygnus Business Media, Fort Atkins, Wisconsin, USA. pp. 30-33.

2009 Blackstone-Ney Ultrasonics—Web page www.blackstone-ney.com. Jan. 2009

Omegasonics—Web page www.omegasonics.com. Jan. 2009.

International Search Report and the Written Opinion of the International Searching Authority issued Oct. 21, 2011, in connection with PCT/US2011/039911.

* cited by examiner

COMBINATION AGITATING PARTS WASHER AND SINK WASHER

CROSS-REFERENCE TO RELATED APPLICATION DATA

This application is a continuation-in-part of U.S. patent application Ser. No. 12/322,233, filed Jan. 29, 2009, which is a continuation-in-part of U.S. patent application Ser. No. 10/658,950, filed Sep. 9, 2003, now U.S. Pat. No. 7,484,515, incorporated herein by reference.

BACKGROUND OF THE INVENTION

The present invention relates to an apparatus for washing articles and more particularly relates to a combination agitating, vat-type and sink washer for washing articles such as automotive parts to remove grease, oil and other contaminants, preferably using a washing fluid which consists of a non-solvent based, non-flammable, biodegradable and environmentally acceptable washing solution.

Various types of parts washers are commonly used in machine shops, garages, automotive shops and the like for removing the grime, oil and contamination from parts. In the past, most parts washers of the sink type utilized toxic cleaning fluids such as petroleum-based solvents and non-biodegradable detergents. The use of such toxic cleaning solutions is environmentally objectionable and, as a result, both state and federal authorities have restricted or severely limited the uses of these types of solutions and solvents.

Accordingly, there developed a need for an environmentally acceptable parts washer which utilizes safe, biodegradable, preferably aqueous cleaning solutions and which are effective to remove accumulated grime, particularly hydrocarbon-based contaminants such as oil and grease.

One type of parts washer is the standard sink-type washer which uses a recirculated solvent which dispenses a cleaning solution at a nozzle or brush. The user will simply scrub the part with the brush and the solvent will assist in removing contaminants. Sink-type parts washers, since they are manual, may be messy and time-consuming in use.

Various sink-type washers can be found in the prior art, such as the ATEC Trans-Tool T-6010-AQ Aqueous Manual Sink Style Parts Washer. Cuda also has a portable, solvent-free manual parts washer.

These devices generally have a sink mounted on a housing which has a reservoir with an accessory such as a flow-through brush, spigot and drain strainer for catching parts. The parts are washed and the solvent flows through the drain into a fluid tank below the sink.

Automatic jet washers are another type of parts washers found in the industry. Generally these type of devices have a cabinet in which is located a spray system connected to a pump for delivering pressurized cleaning solution. A standard jet washer usually includes the cabinet, a basket or turntable on which the parts are to be cleaned and one or more spray manifolds.

Cabinet washers are larger parts washers that have a cabinet with a large load capacity into which the parts are placed for cleaning Parts such as transmission cases, engine blocks, and the like are cleaned in these units. The washers are designed to use a non-flammable, water-based cleaning solution that is sprayed into the cabinet from a manifold.

Also known in the industry are agitating vat-type washers. These washers are designed to allow a larger part to be placed on a tray that sits above a volume of petroleum-based solvent or water-based cleaning solution. The tray can be lowered so that the part soaks in the solution to remove accumulated grime, oil and grease. Some of these vat-type units are also equipped with mechanisms that raise and lower the tray, promoting additional cleaning efficacy through the agitation of the part through the solution as the tray and part rises and lowers.

Other types of parts washers are shown in the prior art. Reference is made to U.S. Pat. No. 5,232,299 which shows a recirculating parts washer which provides both automatic jet washing and manual sink-type brush washing for automotive parts and the like. The parts washer uses a water-based detergent cleaning solution. The housing provides an enclosed wash area, jet wash means providing automatic jet washing, a brush wash means allowing manual cleaning and a pump for delivering a flow of cleaning solution to the wash and brush means.

Thus, while the prior art suggests various types of parts washers including automatic parts washers, sink-type parts washers, jet washers, cabinet-style washers and vat-type washers, there exists the need for a versatile, economical parts washer that can provide multiple washing options, including a parts washing sink, a jet washer and an agitating vat-type washer.

BRIEF SUMMARY OF THE INVENTION

Briefly, the present invention relates to a versatile parts washer that preferably uses a water-based, biodegradable detergent solution for cleaning and degreasing mechanical parts such as automotive parts. The washer can be utilized as a parts washing sink, as well as a jet washer and an agitating vat-type washer. Such a washer is efficient to use and compact and economical to manufacture. The present invention is such a combination unit which provides the benefits of a sink washer, a jet washer and an agitating vat-type washer in a single, compact unit requiring minimal shop floor space.

In one embodiment, the washer has a cabinet, which may be mobile, and may be mounted on casters or wheels so it may easily be moved about in a shop. The cabinet may be any shape but is preferably square or rectangular and fabricated from steel suitably finished and insulated. The cabinet defines a reservoir, a mechanical enclosure and a jet washer compartment which contains electrical connections and other components. A heater is provided for maintaining the washing solution at a suitable temperature for effective contaminant removal. Safety controls, such as a low water level heater shutoff sensor, is located within the housing.

In such an embodiment, a basket for receiving parts to be washed is located within the housing and mounted for rotation in suitable bearings. The basket is foraminous and is rotatably driven in the upper part of the cabinet either by suction-induced fluid flow to the pump or by a suitably sealed gear motor which drives a pulley arrangement. The basket is disposed approximately 1" to 14" below the upper edge of the cabinet so that parts may be easily placed in the basket and removed once cleaned.

The pump has an inlet near the bottom of the housing which will deliver pressurized fluid to a manifold spray which directs pressurized fluid both vertically and horizontally for total coverage of the parts basket in the jet washer compartment.

The upper open end of the cabinet receives a parts sink which may be steel, stainless steel or other durable, chemical resistant material. The sink also serves as a lid or cover for the jet wash compartment in the cabinet. The sink is hinged to the cabinet so that it may be pivoted to the open position to access the interior of the cabinet. Preferably the sink is connected to the cabinet by a suitable mechanism such as a gas spring which will maintain the sink in the open position and dampen the return of the sink to the normal closed position overlying the cabinet.

The sink has a downwardly inclined bottom surface which directs fluid and contaminants to a central drain. The central drain discharges through a strainer. A baffle in the jet spray compartment deflects the jet spray so it does not discharge through the sink drain.

The present invention provides a versatile parts washer providing the combined features of both automatic and manual cleaning utilizing a water-based solution. In one mode of operation, the device is a portable parts washing sink. The cleaning solution is delivered to a brush via a hose and valve to regulate the flow. The parts washing sink can be utilized to clean smaller, less contaminated parts. The jet washer will normally be used to clean larger, more contaminated parts which makes the process more efficient. Small parts may also be washed and cleaned in the jet washer.

The parts can be automatically washed by pivoting the sink to the open position and placing the parts in the basket. The sink is closed to cover the cabinet compartment and the automatic cycle is initiated, causing cleaning solution to be sprayed from a manifold covering the parts in the cleaning basket.

In another embodiment, the parts washer has a manual sink washer for pre-cleaning which drains to a first reservoir. A second, separate reservoir in the hosing is for precision cleaning and has a parts receptacle. After initial cleaning, the parts may be placed in the receptacle in the second reservoir and subjected to precision cleaning by ultrasonic immersion.

In still another embodiment, an agitating vat-type cleaner includes a parts receptacle mounted in the compartment for receiving parts to be washed. The parts receptacle is mounted for reciprocating, vertical movement in the compartment.

An agitator assembly includes one or more compressed gas bladders mounted to the parts receptacle. The bladder has an inlet for introducing compressed gas into the one or more bladders and an outlet for discharge of compressed gas from the one or more bladders. The bladder(s) can be formed in bladder sections that communicate with or are open to one another.

As compressed gas is introduced into the bladder, the bladder inflates and the parts receptacle is raised, and as compressed gas is discharged from the bladder, the parts receptacle is lowered to provide an agitating motion of the parts receptacle.

An alternate washer having an agitator assembly includes a hydraulic assembly mounted to the tray to move the tray and parts in an vertical, reciprocating manner. The washer includes, as with the other embodiments, a heater and pump for supplying the hose/brush assembly. The hydraulic assembly can be located within the housing or on a side or bottom of the housing. A sink can also be provided, similar to the prior embodiments. The hydraulic assembly functions the same as the air bladder assembly to move the tray (and parts) to effect an agitating movement to facilitate cleaning the parts.

These and other features and advantages of the present invention will be apparent from the following detailed description, in conjunction with the appended claims.

BRIEF DESCRIPTION OF THE DRAWINGS

The above and other objects and advantages of the present invention will be more fully understood and appreciated from the following description, claims and drawings in which:

DETAILED DESCRIPTION OF THE INVENTION

Figure 1:
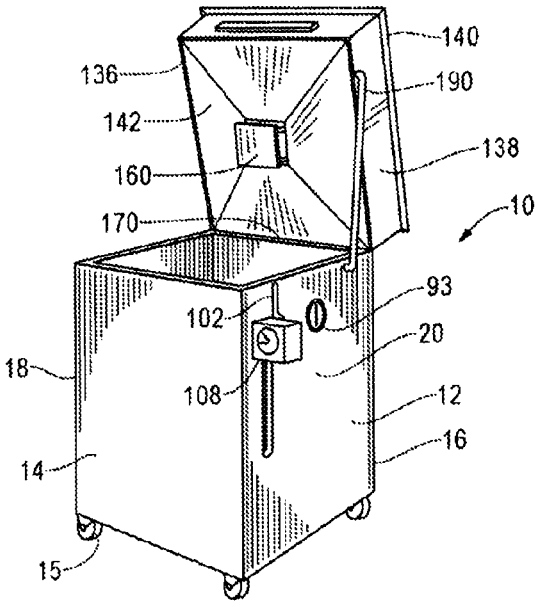
FIG. 1 is a perspective view of the parts cleaning apparatus of the present invention.
Figure 4A:
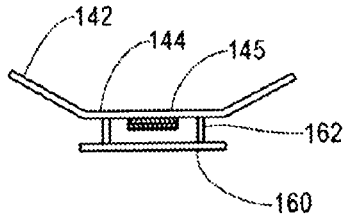
FIG. 4A is a cross-sectional detail of the sink drain.

Turning now to the drawings, the parts washer of the present invention is generally designated by the numeral 10 and includes a lower cabinet generally designated by the numeral 12. The lower cabinet is shown as being generally square or rectangular in horizontal cross-section having front wall 14, rear wall 16 and opposite sidewalls 18 and 20. It will be apparent that the cabinet may be other shapes such as round. The cabinet has a floor 22 and defines a chamber having jet cleaning chamber 25 in its upper end and a fluid reservoir 26 in its lower end. A vertical panel 28 extends between the front wall 14 and rear wall 16. The upper edges of the panel connect to a horizontal panel 30 which defines a mechanical enclosure 32 which is accessible through a vented access door 34 in the sidewall 18. The enclosure 32 may be located at any convenient location in the cabinet. The cabinet 12 may be fabricated from a suitable material such as a 12 gauge, rolled steel which is preferably insulated having a laminated insulative covering. A layer of fiberglass over the steel with a covering a sheet metal stitch-welded to the cabinets is a suitable material for this purpose. The cabinet may be mounted on casters 15 for mobility.

Figure 2:
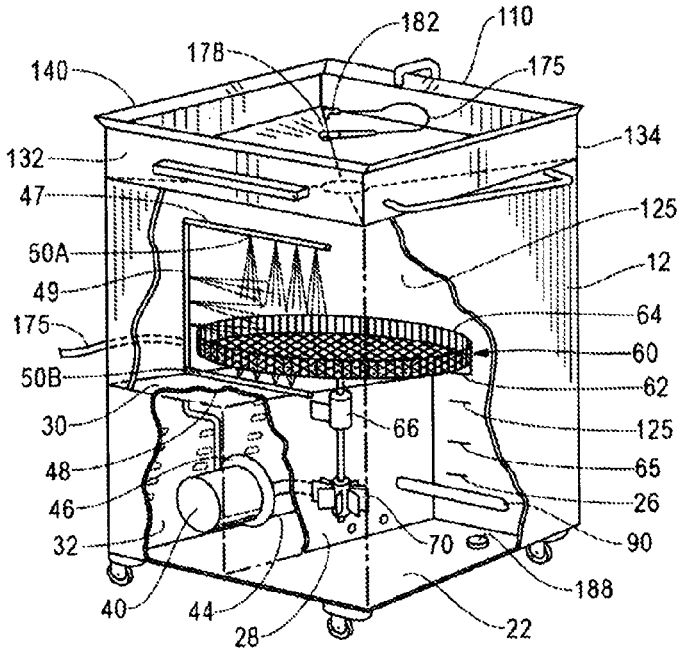
FIG. 2 is a perspective view similar to FIG. 1 partly broken away to illustrate the details of the invention.
Figure 4:
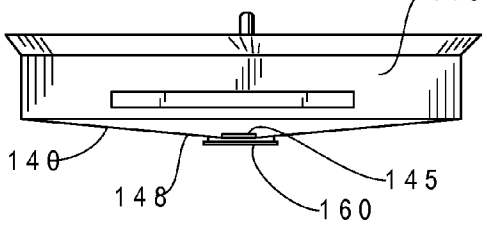
FIG. 4 is a front view of the sink portion of the parts cleaner.
Figure 3:
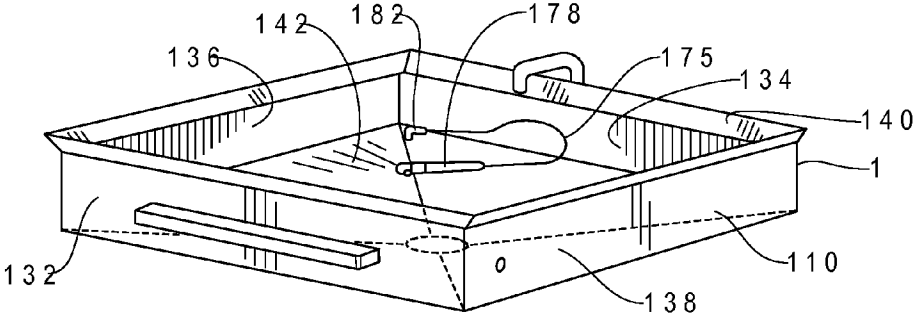
FIG. 3 is perspective view of the sink portion of the parts cleaning apparatus.

As best seen in FIG. 2, a pump 40 such as a pump of the type manufactured by Teel is mounted within the mechanical enclosure 32. The pump 40, typically ¾ to 1½ hp, has an inlet which communicates with the lower reservoir 26 via a conduit 44 in an opening in the vertical baffle 28. The pump discharge is connected to conduit 46 which extends vertically through the horizontal panel 30 along the sidewall 18. The conduit communicates with a spray manifold 50 having upper horizontal section 47, lower horizontal section 48 and vertical section 49. The horizontal sections 47, 48 extend at least half way across the interior of the cabinet. A plurality of orifices 50B are positioned at spaced-apart locations in the vertical manifold section 49. Similarly, a plurality of spaced-apart orifices 50A and 50C are disposed in the horizontal sections 47, 48 of the spray manifold 50 and are disposed to deliver a jet spray upwardly, downwardly and horizontally. The combination of the vertically disposed spray and the horizontal disposed spray patterns will provide a substantially full coverage to insure adequate cleaning of the parts on the parts basket 60 as it rotates with contained parts.

The parts basket 60 is shown as being generally circular with a bottom 62 and a peripheral sidewall 64 of steel mesh. Typically, the diameter of the basket is approximately 18" to 24." A shaft 65 depends downwardly from the center of the bottom 62 of the basket and is mounted in journal bearing 66 for rotation. Rotation to the basket is imparted by fluid flowing from the reservoir 26 into the pump inlet conduit 44. The conduit 44 is in close proximity to a plurality of vanes 70 arranged peripherally around the lower end of the shaft 65. The fluid flow passing the vanes induced by the suction of the pump will cause the shaft and basket to rotate.

In use, the reservoir in the cabinet contains a suitable cleaning solution such as a water-based, non-flammable, biodegradable detergent. The effectiveness of the cleaning solution is enhanced by heating a solution to a suitable temperature, as for example 150° F. Heating is accomplished by a heating element 90 which is shown as an electric resistance heating element that extends into the reservoir 26 at a location above the floor of the cabinet. A thermostat 92 is attached to wall 32 and the opening around the thermostat is sealed. The thermostat is connected to a source of electricity and controls the temperature of fluid within the reservoir.

Figure 6:
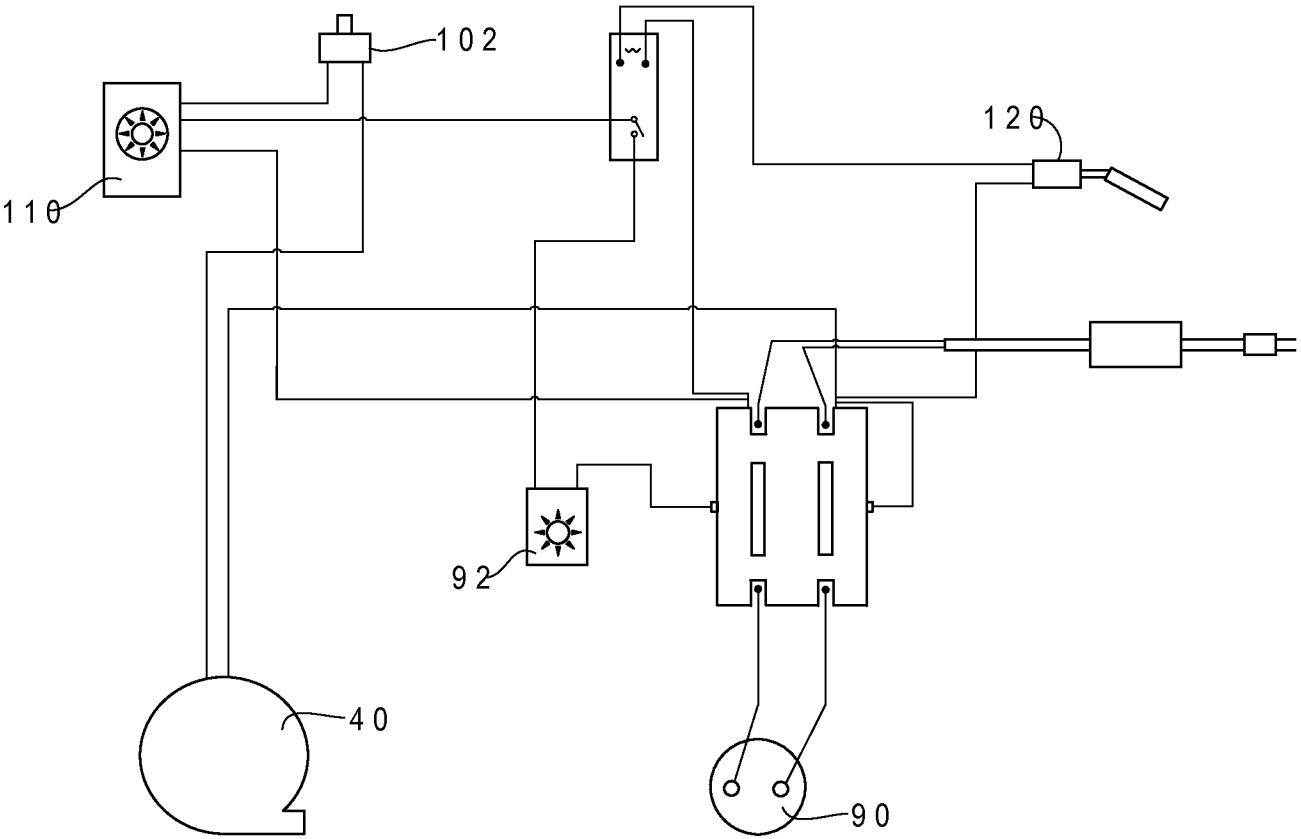
FIG. 6 is a schematic of the electrical system.

FIG. 6 is a schematic of the electrical components. The pump is connected to a source of power such as 110VAC or 220VAC, as appropriate, across a ground fault interruptor. The pump is operable by means of a timer 110 having a safety interlock 102 which is moved to an operative position only when the sink is in a closed position. The timer 110 will energize the pump motor 40 for a predetermined period of time with 10 minutes being typical for most cleaning operations. The pump will withdraw heated washing fluid from the fluid reservoir 26 and direct it through the conduit 46 to the manifold 50 which discharges spray against the washing basket 60. When the timer 110 times out, the pump motor 40 will cease operation and can be restarted by restarting the timer. The thermostat is set at a suitable temperature as for example 150° F. A low fluid level sensor 120 will shut off the pump and heater if the fluid level drops below a minimum level. The fluid level may be visually checked by reference to the level indicator markings 125 on an interior wall of the cabinet.

Safety switch 102 is located on the side of the cabinet and will permit operation of the spray system only when the sink 110 is in the closed position shown in FIG. 2. The sink 110 is a parts washing sink and also serves as the lid or cover for the jet spray chamber within the cabinet. The sink has a front wall 132, rear wall 134 and opposite sidewalls 136, 138. The walls are dimensioned so that the lower edge of the sidewalls extend into the cabinet to fully enclose the chamber when in a closed position.

The sink sidewalls have a continuous circumferentially extending flange or lip 140 which extends outwardly and upwardly at about 25° from the horizontal to assist in containing fluid within the sink. The sink has a floor 142 and is inclined downwardly to a central section 144. The central section 144 defines a drain opening 145 which has a drain screen 148 to prevent small parts from falling through the drain. A horizontal baffle 160 is disposed below the drain suspended on vertically extending hangers 162 from the underside of the sink floor to deflect spray within the interior of the cabinet to prevent if from exiting the drain 145.

The rear wall of the sink is hinged to the rear wall of the cabinet by spaced-apart butt-welded hinges 170. The hinges allow the sink to be pivoted to the open position shown in FIG. 1 or returned to the closed position shown in FIG. 2. In the closed position, the lower edge of the sink rests on flange 172 extending around the interior of the cabinet below the upper edge.

Parts cleaning or washing fluid is directed to the sink through a flexible hose 175 which, at its distal end, terminates at a handle and brush assembly 178. The hose 175 is connected to the manifold 50 so that pump 40 provides a flow of pressurized cleaning solution to the brush. The brush may be metal or a synthetic material. In use, the mechanic may direct a regulated flow of cleaning solution through the brush by manual adjustment of flow control valve 182.

Items to be cleaned are placed in the sink or held over the sink and manually cleaned by brushing the parts using the brush. The flow of cleaning solution through the brush will assist in removing contaminants and will serve to flush the contaminants from the sink into the center drain. Small parts that are inadvertently dropped in the sink will be caught in the drain screen. Fluid and removed contaminants will flow through the drain to be collected in the reservoir. The rear of the sink may also be provided with a fixed nozzle 185 which may be operated to direct a stream of washing fluid on to the part or the item to be cleaned. The stream will flush away contaminants and allows hands-free operation as the part can be placed in the sink with cleaning fluid directed on to the parts. The reservoir 26 may be periodically drained and flushed at drain plug 188.

A suitable closer 190 extends between the sink sidewall 138 and the upper end and at sidewall 20 of the cabinet. Although only one closer is shown, two may be used. The closer serves to maintain the sink in the generally vertical, open position, as seen in FIG. 1, so that the mechanic may access the interior in order to place parts on the cleaning basket or remove them. The closer also will damper closing of the sink so that it slowly descends to the closed position as shown in FIG. 2 overlying the reservoir. The closer will also maintain the sink in a safe, open position when the washer is rolled from one location to another on the casters 15. The closer preferably is a gas spring damper for controlling the lowering of the sink at a controlled, constant speed such as manufactured by Suspa. As indicated, the reservoir contains a suitable cleaning solution such as a water-based, non-flammable, biodegradable detergent solution. The effectiveness of the solution is enhanced by heating the solution. The pump, when actuated, withdraws fluid from the reservoir and discharges it through the spray nozzles or through the manual brush or both.

As mentioned above, an important aspect of the present invention resides in the versatility of the device in that it can be used as an automatic jet washer, as well as a parts washer. When used as a jet washer, the sink will be pivoted to the open position as shown in FIG. 1 and parts to be cleaned can be placed on the parts basket 60. Once the sink is returned to the closed position, the safety interlock 102 will allow the user to actuate the pump causing fluid to be delivered to the manifold system and also causing the fluid impart rotation to the basket. Generally, the jet washing cycle will be set for a predetermined period of operation controlled by the timer, as for example 10 minutes. When the cleaning cycle is completed, the sink can be lifted to the open position to provide access to the interior chamber and the parts can be removed.

Fluid is delivered through hose 175 to the brush 178 from the manifold 50. Fluid and removed contaminants are removed from the sink by hand washing and will be discharged from the sink into the cabinet reservoir. It is not necessary for the user to place the parts to a separate sink such as the side-by-side sink of a conventional part washer. The design of the parts washer of the present invention is extremely versatile, compact and economical. The user is not required to buy three separate units as is often the case with conventional washers.

Further, the device may be portable as the casters 15 can allow the device to be easily transported to the area where the mechanic is working, as for example as is the case when a vehicle is on a lift and the mechanic is replacing brake parts and the brake components require cleaning. In this case, the sink can be positioned below the brake assembly. The brush can be applied to the brake parts on the vehicle and the fluid and contaminants collected in the sink and will flow into the sink and will flow into the cabinet.

Figure 5:
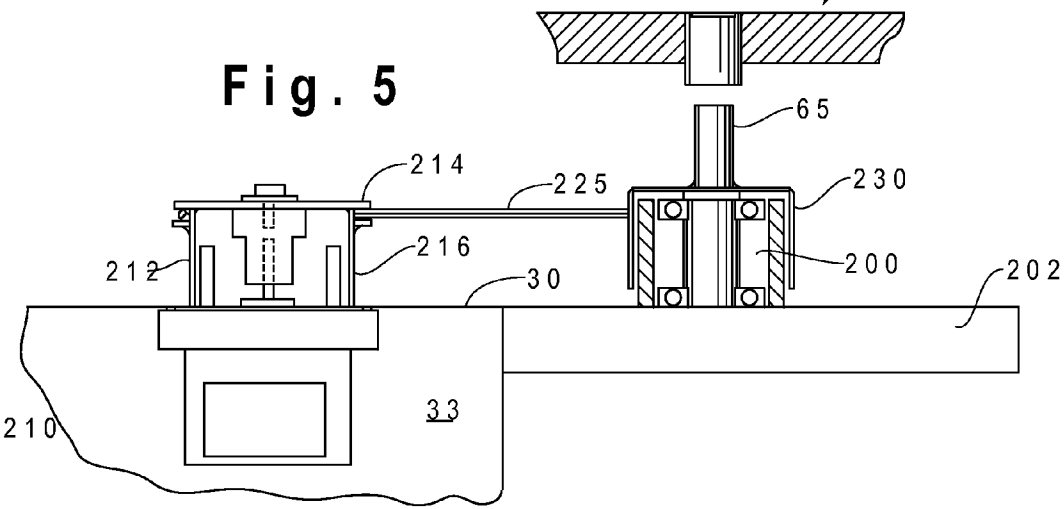
FIG. 5 is detail view illustrating an alternate drive assembly for the parts basket.
Figure 8:
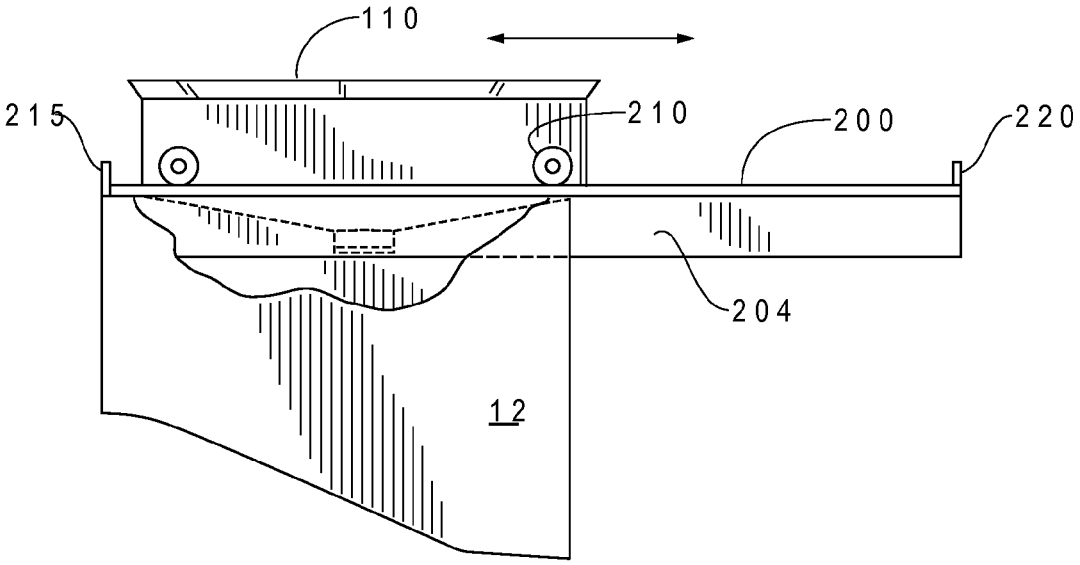
FIG. 8 is a front view of still another embodiment of the parts washer sink cabinet.

FIG. 5 illustrates an alternate drive mechanism for the rotatable parts basket 60. In this case, basket 60 is supported on a bearing assembly 200 located on a support channel 202 extending from wall 28 of the enclosure 32. A gear motor 210, such as a fractional horse power gear motor is mounted within the mechanical enclosure having an output shaft 212 extending vertically through panel 30. The opening in the panel is suitably sealed. A pulley 214 is attached to the output shaft and may include a downwardly depending cup 216 to protect the shaft. An O-ring belt 225 extends from the pulley 214 to a cylindrical cup 230 secured to the lower end of the basket support shaft 65. The relative diameters of the gear motor spindle and the basket support pulley can be selected to provide the appropriate rotational speed for the basket. Typically, rotational speeds will be from approximately from 1 to 10 rpm. The O-ring belt is twisted into a figure-8 configuration to increase retention so it will not slip on the exterior of the cup 230. Actuation of the gear motor will drive the basket through the O-ring belt and pulley system.

Figure 7:
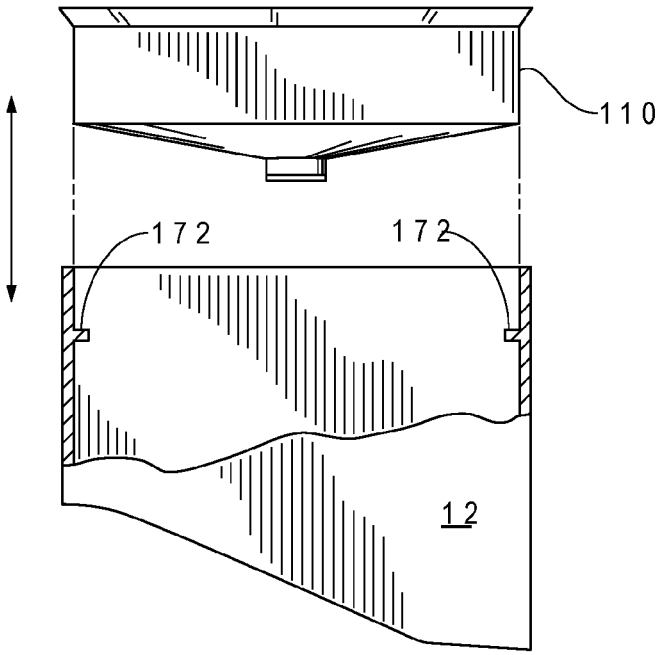
FIG. 7 is a front view of another embodiment of the sink and cabinet.

FIG. 7 shows another embodiment of the invention in which the sink 110 rests on flange 172 in the closed position. The sink 110 is a lift-off sink which may be removed to access the interior of the cabinet 12 or may be placed on the flange 172 to enclose or cover the jet washing chamber.

In FIG. 8, the sink 110 again has a closed position over the top of the cabinet. The sink 110 has rollers 210 which rest on guide rails 200 and may be slid rearwardly to an open position or moved forwardly to a closed position. Side panels 204 extend rearwardly to enclose the sink when in the forward position to prevent spray from exiting the cabinet. Stops 215 and 220 limit the travel of the sink.

Figure 9:
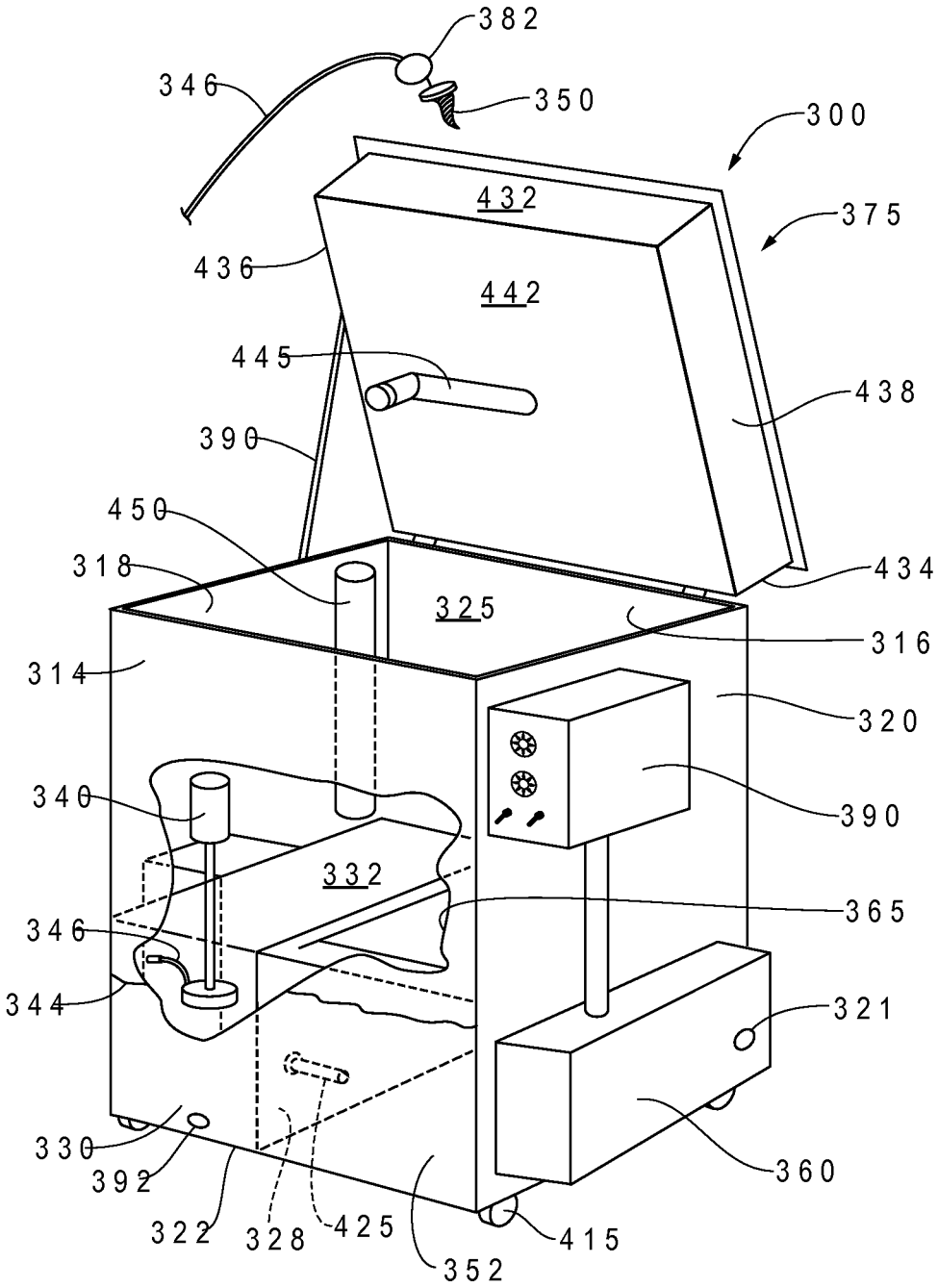
FIG. 9 is a perspective view of another embodiment of the parts washer according to the present invention incorporating ultrasonic cleaning.

In FIG. 9, another embodiment of the present invention is shown which is designated by the numeral 300 and includes a lower cabinet 310 having front wall 314, rear wall 316, and opposite side walls 318 and 320. The cabinet has a floor 322 and defines an internal chamber 325.

A vertical panel 328 extends between the front and rear walls forming a first reservoir 330. A removable cover panel 332 extends over the reservoir 330. A pump 340 is mounted within the reservoir 330 having an inlet 344. The pump discharge is connected to a conduit 346 which communicates with a manual cleaning device 350 in sink 375 such as a spout or brush.

A second reservoir 352 is in chamber 325 adjacent reservoir 330 defined by panel 328, front wall 314, rear wall 316, sidewall 320 and floor 322. Mounted on sidewall 320 are one or more ultrasonic transducers 321 in housing 360 which are connected to an ultrasonic generator to direct ultrasonic waves to the fluid contained in the reservoir 352. A parts receptacle or basket 365 is sized to be received in the reservoir 352. The basket may be wire mesh having handles for convenience so it may be lifted from or placed in the reservoir 352. The reservoirs in the cabinet contain a suitable cleaning solution such as a water-based, non-flammable biodegradable detergent.

Sink 375 is a manual parts washing sink and also serves as a cover or lid for the chamber 325. The sink has a front wall 432, rear wall 434 and opposite sidewalls 436, 438. A floor 442 is inclined downwardly to a drain pipe 445. The sink is dimensioned to fully enclose the chamber 325 when in the closed position. A suitable closer 390 such as a gas spring extends between the sink and sidewall 436 and the cabinet sidewalls. In the closed position, drain pipe 445 is received within the drain tube 450 which communicates with reservoir 330 to direct and return fluid from the sink to the reservoir.

Fluid for manual cleaning is directed through conduit 346 which at its distal end terminates at a cleaning device 350 such as a brush or spout. The conduit may include a flow valve 382 to regulate the flow of fluid to the cleaning device. Electrical controls for the pump, transducers and resistance heaters 425 are housed in the electrical panel 390.

Parts to be cleaned are placed in the sink 375 or held over the sink and may be manually cleaned using the cleaning device 350. The flow of cleaning solution through the device will assist in pre-cleaning by removing contaminates which will then be carried through the drain tube 450 to the reservoir 330. The major contaminates will be flushed away in the pre-cleaning operation and will be collected in the reservoir 330 which will be periodically flushed and replenished with clean fluid at a drain plug 392. The pre-cleaning in the sink and collection of the pre-cleaning fluid in the separate reservoir 330 avoids excessive contamination of the precision cleaning reservoir 352 resulting in better overall cleaning efficiency.

Subsequent to preliminary cleaning, the parts may then be precision cleaned by placing the parts in receptacle 365 and immersing them in fluid in reservoir 352. The initial pre-cleaning and subsequent ultrasonic cleaning results in highly effective removal of contaminates from the parts and in small crevices in the parts. The washer preferably is mounted on casters 415 for portability and ease of operation.

Figure 10:
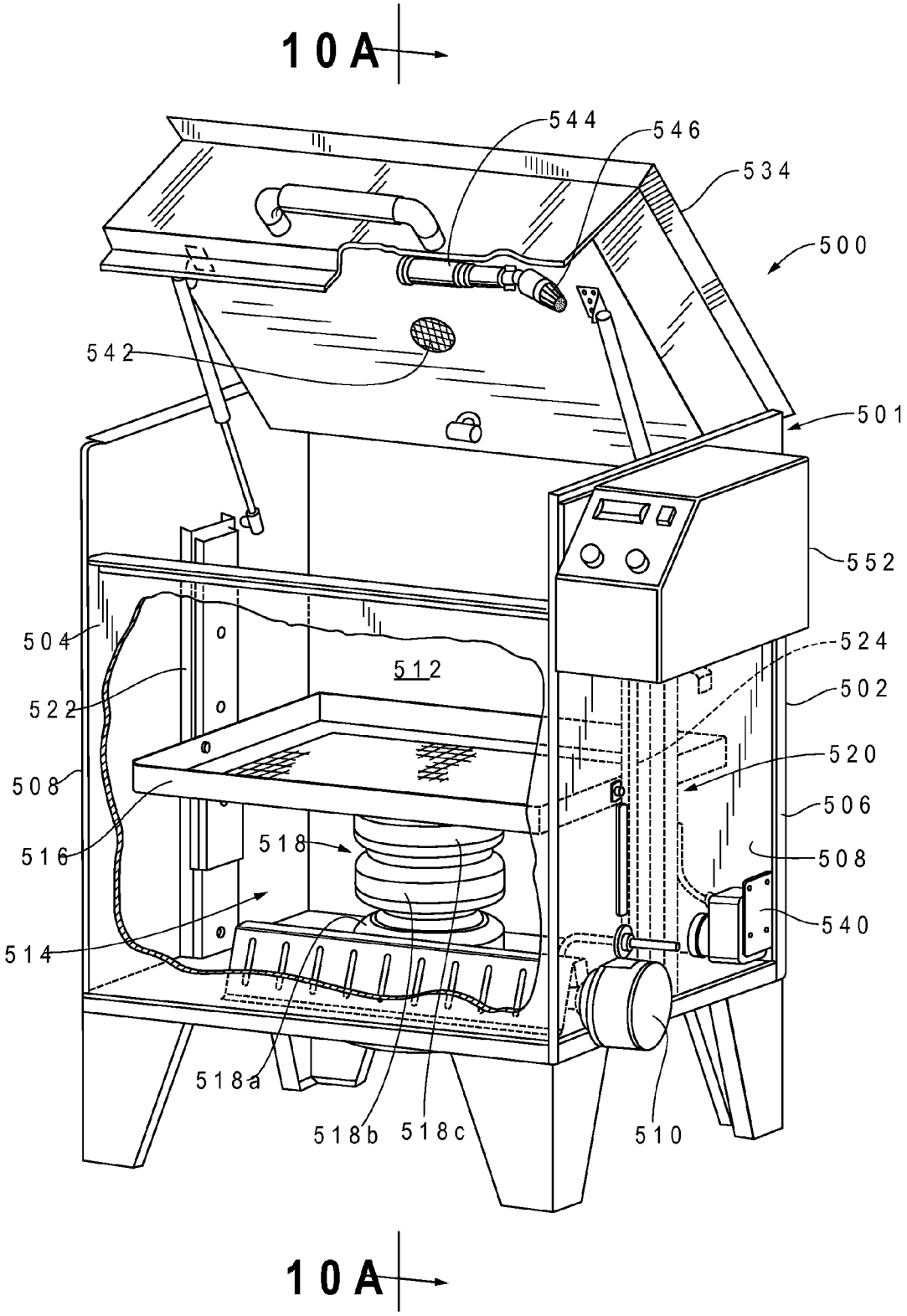
FIG. 10 is a perspective view of still another alternate embodiment of the parts cleaner having an agitator system, shown with the sink or cover in an open condition, in accordance with the principles of the present invention.
Figure 10A:
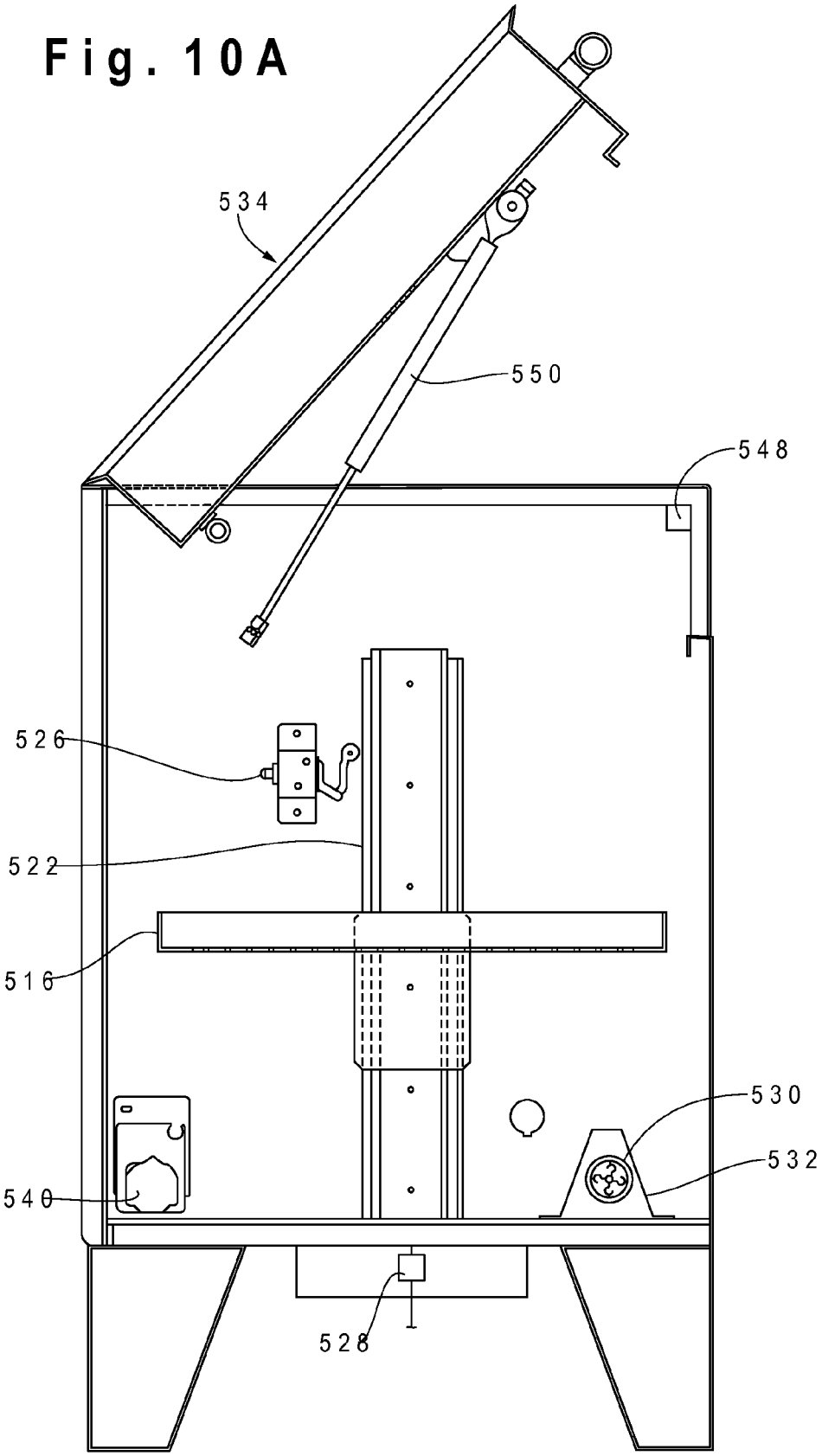
FIG. 10A is a sectional view taken along lines 10A-10A of FIG. 10.
Figure 11:
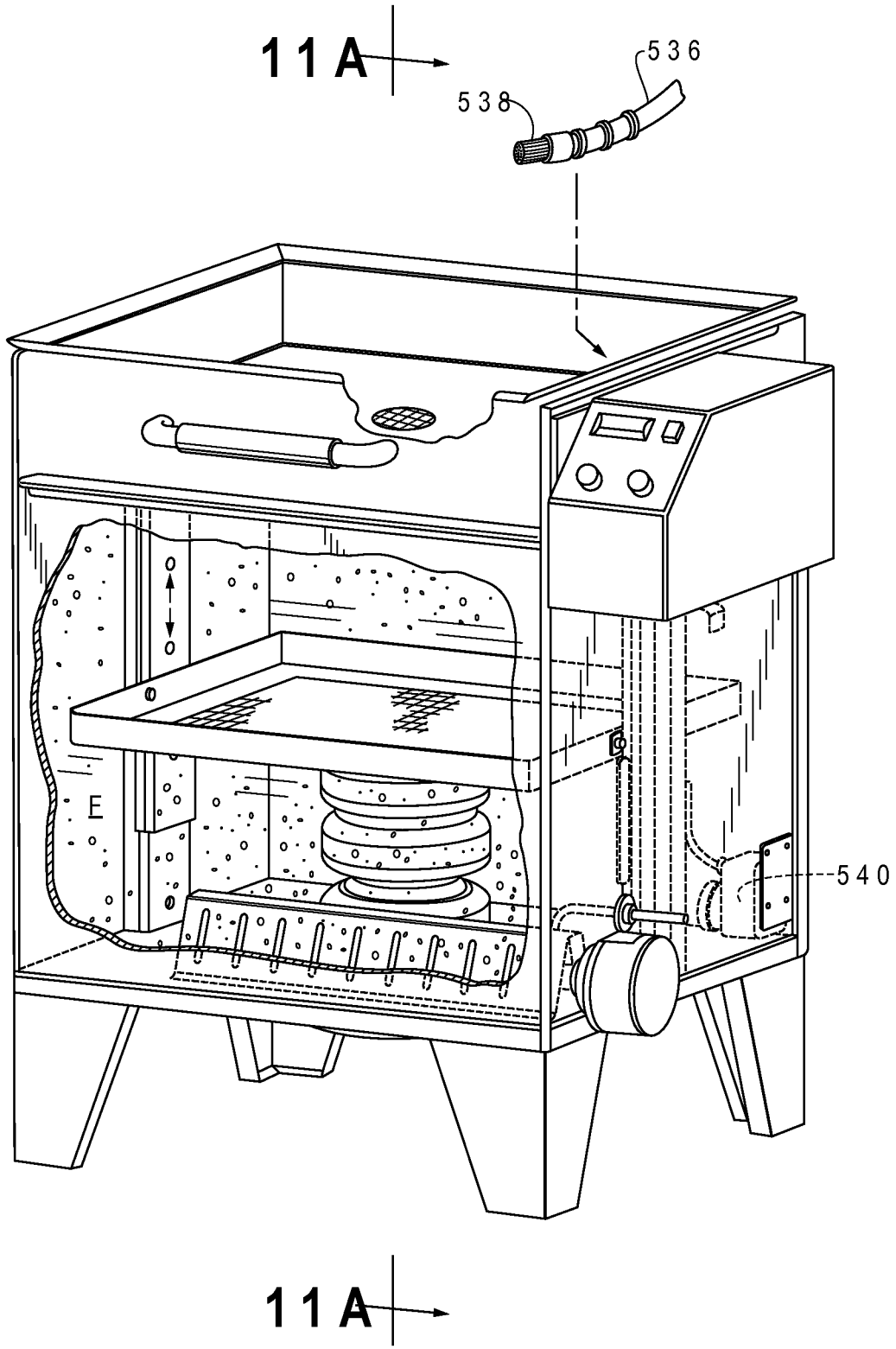
FIG. 11 is a partially broken away perspective view, with the sink or cover closed.
Figure 11A:
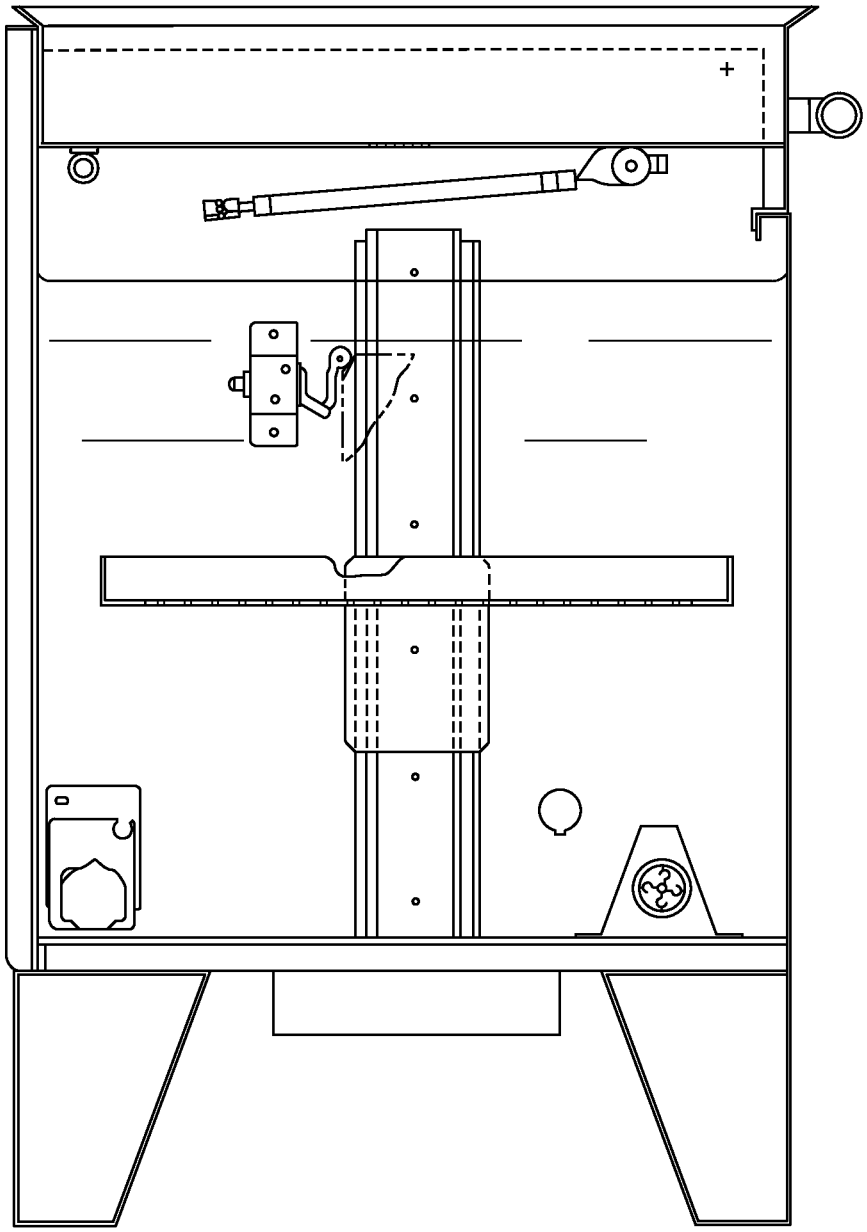
FIG. 11A is a sectional view taken along lines 11A-11A of FIG. 11.

Still another embodiment of the parts washer 500 is shown in FIGS. 10-11A. The washer 500 includes a cabinet 501, having a lower cabinet 502, with a front wall 504, a rear wall 506, and opposing side walls 508. The cabinet 501 is shown having a rectangular or square shape, but as will be appreciated by those skilled in the art, the cabinet 501 can have many different sizes and shapes to fit a particular application. A present washer 500 has about a 50 gallon fluid F capacity. The cabinet 501 has a floor 510 and defines a chamber indicated at 512 for agitation washing.

An agitator system 514 is positioned in the agitation chamber 512. The system 514 includes a tray 516 on which parts are positioned for cleaning. The tray 516 is preferably foraminous, and can be formed from a screen or open mesh material. It is anticipated that the tray 516 will be formed from a non-corroding metal material (such as stainless steel), a coated metal material (such as a coated steel) or a high strength polymer (plastic) material so that relatively heavy objects can be placed on the tray 516.

The system 514 includes an air or gas bladder or series of air or gas bladders 518 that are inflated and deflated to increase and decrease the volume (height) of the bladders 518. As illustrated, one air bladder 518 having three (3) air bladder sections 518*a-c* are used in a present system 514, however, any reasonable number of bladders or bladder sections 518 may be used. The bladder 518 is referred to as an air bladder, but any compressed gas can be used to inflate the bladder 518. A compressor (not shown) can be included with the washer 500, or any suitable source of pressurized gas can be provided.

As can be seen, the bladder sections 518*a-c* are presented in series in a vertical orientation, below and at about a center of the of the tray 516. Accordingly, in order to maintain the tray 516 in a horizontal orientation the system 514 includes a mounting 520 pair of guide rails or guide towers 522 to which the tray 516 is mounted. The mounting 520 includes bearings 524 to permit the mountings 520 (and the tray 516) to smoothly move up and down within the cabinet 501, as balanced and held horizontal by the guide rails 522. A limit switch 526 on one or both of the guard rails 522 provides an upper stop location for the tray 516. The deflated bladder 518 provides a lower stop.

One or more valves 528 are located in an enclosure 530 below the cabinet 501. the valves 528 control the flow of compressed gas to and from the bladders 518 to inflate the bladder 518 to raise the tray 516 and to deflate the bladder 518 to lower the tray. In a present system 514 gravity (with the valves 528 open to atmosphere) deflates the bladders and lowers the tray. It will be appreciated that although not shown, a driven system can be used to force air from the bladder 518 to lower the tray as well, and that such a driven is within the scope and spirit of the present invention.

A heater 530 in the cabinet 501 is used to heat the cleaning fluid F to enhance the cleaning ability of the fluid F. The heater 530 can, as illustrated, be covered or protected by a cover 532 (or baffle) to prevent damage to the heater 530 (as by parts falling from the tray 516 or dropped into the cabinet 501) and prevents personnel from inadvertently touching the heater 530 element when the cabinet 501 is opened.

A sink or cover 534 is positioned at the top of the cabinet 501. As with the prior embodiments, the sink 534 is used to manually wash parts, as needed. A hose 536 with, for example, a brush 538 attached to an end thereof, can be included to facilitate manual washing. A pump 540 is positioned in the cabinet 501 and draws fluid F from the cabinet 501 and pumps it to the hose 536 to facilitate manual (e.g., brush) cleaning A drain 542 in the sink 534 drains fluid F back to the cabinet 501.

An additional hose 544 and brush 546 assembly is provided within the chamber 512, located below, preferably mounted to the bottom of the sink 534. The chamber hose 544 and brush 546 assembly is provided to permit manually washing items that are placed on the tray 516 with the fluid F returning directly to the chamber 512. Valves (not shown) are located at each of the hose and brush assemblies 536, 538 and 544, 546 to control the flow of fluid F to the respective assemblies.

The agitator system tray 516 moves in a continuous manner along the rails 522. In an uppermost position, the tray 516 can be loaded with the part or parts to be cleaned. Manual cleaning can be carried out with the part on the tray 516, using the chamber hose 544 and brush 546 assembly. The cover (sink) 534 can then be closed and an agitation cycle commenced. In an agitation cycle, the tray 516 moves in an up-and-down manner along the rails 522, by inflation and deflation of the bladder 518. It is anticipated that the total distance traveled by the tray 516 is about 10 inches to 20 inches and each stroke (up or down) is carried out in about 3 seconds to 4 seconds. This agitation further enhances cleaning the part.

The washer can include one or more interlocks 548 that prevent the washer 500 from moving into an agitation cycle when the cover or sink 534 is open. Gas cylinders 550 positioned between the sink 534 and the cabinet 501 facilitate maintaining the sink 534 up and the cabinet 501 in an open condition. A controller 552 controls the overall automatic (e.g., agitation cycle) of the washer 500.

Figure 12:
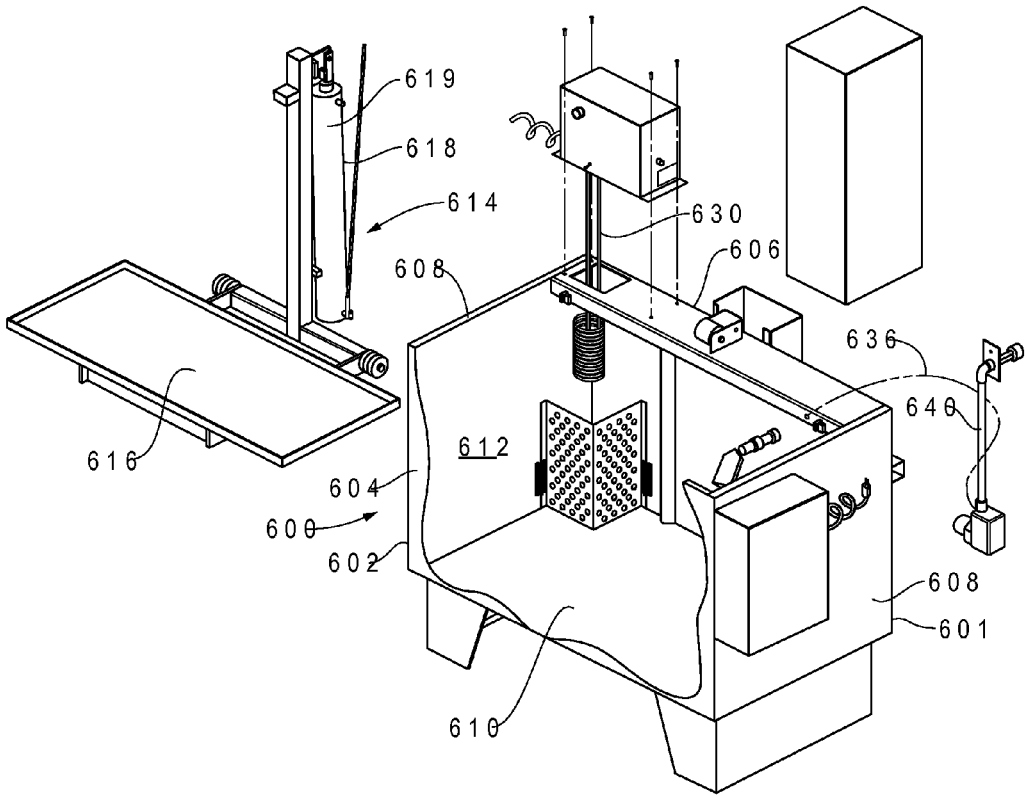
FIG. 12 is a an exploded view of still another alternate embodiment of the parts cleaner, shown without the sink or cover in place for ease of illustration, the cleaner being of the agitating-type and having a hydraulic system to effect the agitating movement.

Still another type of agitating washer is shown in FIG. 12. The washer 600 includes a cabinet 601, having a lower cabinet 602, with a front wall 604, a rear wall 606, and opposing side walls 608. The cabinet defines a chamber indicated at 612 for agitation washing. The cabinet 601 is shown without a sink for ease of illustration, but those skilled in the art will appreciate that such a sink can be a part of the washer 600.

An agitator system 614 is positioned in the agitation chamber 612. The system 614 includes a tray 616 on which parts are positioned for cleaning. The tray 616 can be foraminous as shown in the prior embodiments of the washer. It is anticipated that the tray 616 will be formed from a non-corroding material with sufficient strength to support/carry relatively heavy objects placed on the tray 616.

In this agitator system 614, a hydraulic system 618 including a hydraulic cylinder 619 is used to effect the movement (up and down, reciprocating movement) of the tray 616. The hydraulic system 618 as shown is mounted within the chamber 612, but can be mounted externally of the cabinet 601 as in the rear 606 or bottom, below the floor 610 of the cabinet 601 with appropriate seals provided to provide for fluid collection and/or to prevent leakage as appropriate. The washer 600 also includes a heater 630 to heat the fluid and a pump 640 to supply fluid to one or more hose/brush assemblies 636/638 for parts cleaning, whether in the sink (not shown) or when, for example, a part is placed on the tray 616 with the tray 616 in a raised position for easy cleaning access. Operationally, the hydraulic agitator system 64 functions the same or similar to the air bladder system 514 and can include the same interlocks and functional control system. Other types of agitating systems can be used and will be recognized by those skilled in the art and such other types of agitating systems are within the scope and spirit of the present invention.

It will be seen that the present invention provides a unique, efficient parts washer. Because of the compactness of design and its ability to be used as both a manual sink, an automatic jet washer and an undercarriage parts cleaner. As such, the washer of the present invention replaces several units in the shop area providing substantial economy to the shop operator. The washer may be mobile and may be transported to a work location as beneath a lift or hoist to assist a mechanic working on a brake system. Multiple manual cleaning operations can be accomplished with the same unit further increasing efficiency of the mechanic and increasing profitability.

In the present disclosure, the words "a" or "an" are to be taken to include both the singular and the plural. Conversely, any reference to plural items shall, where appropriate, include the singular.

All patents referred to herein, are hereby incorporated herein by reference, whether or not specifically done so within the text of this disclosure.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A multi-function parts washer for removing contaminants from parts either by hand or automatically using an aqueous cleaning fluid, the parts washer comprising:

a base cabinet having sides, a floor and an open top defining a compartment;

a parts receptacle mounted in the compartment for receiving and supporting parts to be washed, the parts receptacle mounted for reciprocating, vertical movement in the compartment;

an agitator assembly including one or more compressed gas bladders mounted to and supporting the parts receptacle, the one or more compressed gas bladders having an inlet for introducing compressed gas into the one or more bladders and an outlet for discharge of the compressed gas from the one or more compressed gas bladders;

a top formed as a sink movably positioned at the open top of the base cabinet so as to provide access to the compartment; and one or more guides operably mounting the parts receptacle to the base cabinet, wherein as compressed gas is introduced into the one or more bladders, the one or more bladders inflate and the parts receptacle is raised along the one or more guides, and wherein as compressed gas is discharged from the one or more bladders, the parts receptacle is lowered along the one or more guides to provide an agitating motion of the parts receptacle.

2. The parts washer in accordance with claim 1 including a pair of guides mounted on opposites sides of the parts receptacle.

3. The parts washer in accordance with claim 1 including bearings for mounting the parts receptacle to the guides to permit reciprocating movement of the parts receptacle.

4. The parts washer in accordance with claim 1 wherein a bottom of the sink defines an upper boundary of the compartment, and wherein the sink includes a drain.

5. The parts washer in accordance with claim 4 including a first hand washer for manually cleaning parts in the sink.

6. The parts washer in accordance with claim 1 including a second hand washer, the second hand washer mounted within the compartment for manually cleaning parts on the parts receptacle.

7. The parts washer in accordance with claim/including valving for independently controlling the flow of cleaning fluid to the first and second hand washers.

8. The parts washer in accordance with claim 1 including a heater for heating the cleaning fluid.

9. The parts washer in accordance with claim 1 including compressed gas inlet and discharge valves in flow communication with the one or more compressed gas bladders, wherein the inlet and discharge valves control the flow of compressed gas into and from the one or more compressed gas bladders.

10. The parts washer in accordance with claim 1 including compressed gas inlet and discharge valves in flow communication with the one or more compressed gas bladders, wherein the inlet and discharge valves control the flow of compressed gas into and from the one or more compressed gas bladders.

11. The parts washer in accordance with claim 10 including an interlock disposed between the sink and the cabinet to sense an opened or closed state of the cabinet, the interlock operably connected to the compressed gas inlet and discharge valves to prevent the flow of compressed gas to the one or more compressed gas bladders when the cabinet is in the opened state.

12. The parts washer in accordance with claim 1 wherein each of the one or more compressed gas bladders is formed in sections in communication with one another.

13. The parts washer in accordance with claim 12 including one gas bladder and wherein the one gas bladder is formed in at least two sections.

14. The parts washer in accordance with claim 13 wherein the one gas bladder is formed in three sections.

* * * * *

UNITED STATES PATENT AND TRADEMARK OFFICE

CERTIFICATE OF CORRECTION

PATENT NO. : 8,763,619 B2
APPLICATION NO. : 12/816228
DATED : July 1, 2014
INVENTOR(S) : Ashok S. Lele et al.

It is certified that error appears in the above-identified patent and that said Letters Patent is hereby corrected as shown below:

On the Title Page, References Cited

On Page 2, under "OTHER PUBLICATIONS", Column 2, line 4, "2009 Blackstone-Ney" to read as --Blackstone-Ney--.

In the Specification

Column 1, line 60, "cleaning" to read as --cleaning.--.

Column 9, line 11, "of the of the" to read as --of the--.

Column 9, line 23, "501. the" to read as --501. The--.

Column 9, line 46, "cleaning" to read as --cleaning.--.

In the Claims

Column 12, Claim 6, line 3, "claim 1" to read as --claim 5--.

Column 12, Claim 7, line 7, "claim/" to read as --claim 6--.

Signed and Sealed this
Twenty-fourth Day of February, 2015

Michelle K. Lee

Michelle K. Lee
*Deputy Director of the United States Patent and Trademark Office*